US007427586B2

(12) United States Patent
Liu et al.

(10) Patent No.: US 7,427,586 B2
(45) Date of Patent: Sep. 23, 2008

(54) DEGREASING AGENT

(75) Inventors: Xian-Liang Liu, Shenzhen (CN); Rui-Feng Zhang, Shenzhen (CN); Jian-Bin Zhao, Shenzhen (CN)

(73) Assignees: Shenzhen Futaihong Precision Industry Co., Ltd., ShenZhen, Guangdong Province (VG); Sutech Trading Limited, Tortola (VG)

( * ) Notice: Subject to any disclaimer, the term of this patent is extended or adjusted under 35 U.S.C. 154(b) by 0 days.

(21) Appl. No.: 11/933,899

(22) Filed: Nov. 1, 2007

(65) Prior Publication Data

US 2008/0146483 A1 Jun. 19, 2008

(30) Foreign Application Priority Data

Dec. 15, 2006 (CN) ..... 2006 1 0157536

(51) Int. Cl.

| | |
|---|---|
| ***C11D 1/28*** | (2006.01) |
| ***C11D 1/72*** | (2006.01) |
| ***C11D 3/08*** | (2006.01) |
| ***C11D 9/12*** | (2006.01) |
| ***C11D 9/14*** | (2006.01) |
| ***C11D 13/10*** | (2006.01) |

(52) U.S. Cl. ..... 510/245; 510/175; 510/251; 510/260; 510/261; 510/267; 510/271; 510/421; 510/429; 510/466; 510/467

(58) Field of Classification Search ..... 510/175, 510/245, 251, 260, 261, 267, 271, 421, 429, 510/466, 467

See application file for complete search history.

(56) References Cited

U.S. PATENT DOCUMENTS 6,211,132 B1 * 4/2001 Pierce et al. ..... 510/365

* cited by examiner

*Primary Examiner*—Brian P Mruk

(57) ABSTRACT

A degreasing agent includes a mixture of trisodium phosphate, sodium silicate, sodium carbonate, sodium dodecyl benzene sulphonate, sodium hydrosulphite and octyl-phenol-polyoxyethylene ether. The degreasing agent may maintain degreasing effect for longer period of time. In addition, the metal product cleaned by the degreasing agent has a low cleaning inferior rate.

8 Claims, No Drawings

DEGREASING AGENT

BACKGROUND OF THE INVENTION

1. Field of the Invention

The present invention relates to a degreasing agent and, particularly, to a degreasing (i.e. removing oil, grease and other containments) agent used for washing metal and a method for making the degreasing agent.

2. Description of Related Art

Degreasing process is widely used for pretreatment of a metal surface in the electroplating industry. The role of the degreasing process is to clean the metal surface with degreasing agent so as to remove extraneous substance such as fingerprints, fats, oils and other organic substances.

A conventional degreasing agent is composed of alkaline and surface-active agent or the like. Surface-active agent/surfactant serves as a main factor of the degreasing effect. However, with many different types of surface-active agent out on the market, it can easily be mistakenly chosen which will affect the degreasing effect. The Ching Feng Precision Chemicals Company in Taiwan produces a known degreasing agent, such as Ching Feng 103. This kind of the degreasing agent is high in cost, and the time for maintaining the degreasing effect is too short. In addition, the degreasing property is weak, thus, the degreasing agent cannot effectively cleanse the metal surface.

Therefore, an improved degreasing agent is desired in order to overcome the above-described shortcomings.

SUMMARY OF THE INVENTION

In one aspect, a degreasing agent includes a mixture of trisodium phosphate, sodium silicate, sodium carbonate, sodium dodecyl benzene sulphonate, sodium hydrosulphite and octyl-phenol-polyoxyethylene ether.

In another aspect, a method for making the degreasing agent includes: mixing trisodium phosphate, sodium silicate, sodium carbonate, sodium dodecyl benzene sulphonate, and sodium hydrosulphite together; putting water into a tank to dissolve the trisodium phosphate, sodium silicate, sodium carbonate, sodium dodecyl benzene sulphonate, sodium hydrosulphite; adding octyl-phenol-polyoxyethylene ether to the tank.

Other advantages and novel features will become more apparent from the following detailed description.

DETAILED DESCRIPTION OF THE INVENTION

The present degreasing agent is suitable for washing a metal surface. It is to be understood that the surface can be any type of surface resistant to the degreasing agent, for example a metallic surface, a glass surface, a plastic surface, a concrete surface etc. The metallic surface can be a steel surface, an austenitic steel surface, an aluminum zirconium surface etc.

The degreasing agent includes trisodium phosphate, sodium silicate, sodium carbonate, sodium dodecyl benzene sulphonate, sodium hydrosulphite and octyl-phenol-polyoxyethylene ether. Sodium dodecyl benzene sulphonate and octyl-phenol-polyoxyethylene ether are surface-active agent. Sodium dodecyl benzene sulphonate is a solid powder and octyl-phenol-polyoxyethylene ether is a glutinous liquid.

The degreasing agent includes mixtures of trisodium phosphate 31% to 41% by weight, sodium silicate 18% to 23% by weight, sodium carbonate 8% to 12% by weight, sodium dodecyl benzene sulphonate 2% to 6% by weight, sodium hydrosulphite 25.5% to 29.5% by weight and octyl-phenol-polyoxyethylene ether 0.8% to 1.7% by weight. In a preferred embodiment, the degreasing agent includes 38% of trisodium phosphate by weight, 20% of sodium silicate by weight, 10% of sodium carbonate by weight, 2% of sodium dodecyl benzene sulphonate by weight, 29% of sodium hydrosulphite by weight and 1% of octyl-phenol-polyoxyethylene ether by weight.

The degreasing agent is prepared by the following steps: firstly, each composition except for octyl-phenol-polyoxyethylene ether is uniformly combined by proportion. Secondly, the above combination is added into an ultrasonic tank filled with hot water about 70±5° C. Finally, the above combinations are dissolved, octyl-phenol-polyoxyethylene ether is then added into the ultrasonic tank, thereby forming the degreasing agent.

The test result of the degreasing agent and Ching Feng 103 will be compared so as to explain different cleaning effects. Firstly, two stainless iron samples are respectively dipped into two ultrasonic tanks. Each ultrasonic tank is respectively filled with the degreasing agent and Ching Feng 103. The temperature of the ultrasonic tanks is about 80±5° C. An electrical current of the direct current power applied to the ultrasonic tank is between 2A and 3A. The samples are to be soaked in the ultrasonic tank for 5 minutes and then extract to be washed and dried. The following table shows these measurements parameters and results:

| | Composition | |
|---|---|---|
| Parameters | Degreasing agent | Ching Feng 103 |
| Concentration | 5% | 5% |
| Ultrasonic tank temperature | 80 ± 5° C. | 80 ± 5° C. |
| Electric current | 2~3 A | 2~3 A |
| Time | 5 min | 5 min |
| Speed | 1.89 m/min | 1.89 m/min |
| Dry temperature | 109 ± 5° C. | 109 ± 5° C. |
| Maintaining degreasing effect time | 16 H | 12 H |
| Price | 2.7~4.0RMB | 5.0RMB |
| Cleaning inferior rate | 1.0% | 6.7% |

The above data shows when the outside circumferences are the same, the present degreasing agent not only maintains degreasing effect for longer period of time, it also cost less than the Ching Feng 103. In addition, the metal product cleaned by the degreasing agent has a low cleaning inferior rate.

Understandably, the present degreasing agent may be used on copper, nickel or ceramic surface.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A degreasing agent comprising a mixture of trisodium phosphate, sodium silicate, sodium carbonate, sodium dodecyl benzene sulphonate, sodium hydrosulphite and octyl-phenol-polyoxyethylene ether.

2. The degreasing agent as claimed in claim 1, wherein the degreasing agent comprises 31% to 41% trisodium phosphate by weight, 18% to 23% sodium silicate by weight, 8% to 12% sodium carbonate by weight, 2% to 6% sodium dodecyl benzene sulphonate by weight, 25.5% to 29.5% sodium hydrosulphite by weight and 0.8% to 1.7% octyl-phenol-polyoxyethylene ether by weight.

3. The degreasing agent as claimed in claim 1, wherein the degreasing agent includes 38% of trisodium phosphate by weight, 20% of sodium silicate by weight, 10% of sodium carbonate by weight, 2% of sodium dodecyl benzene sulphonate by weight, 29% of sodium hydrosulphite by weight and 1% of octyl-phenol-polyoxyethylene ether by weight.

4. A method for making the degreasing agent, comprising:

mixing trisodium phosphate, sodium silicate, sodium carbonate, sodium dodecyl benzene sulphonate, sodium hydrosulphite;

putting water into a tank to dissolve the trisodium phosphate, sodium silicate, sodium carbonate, sodium dodecyl benzene sulphonate, sodium hydrosulphite;

adding octyl-phenol-polyoxyethylene ether to the tank to get the degreasing agent.

5. The method for making the degreasing agent as claimed in claim 4, wherein the degreasing agent comprises trisodium phosphate 31% to 41% by weight, sodium silicate 18% to 23% by weight, 8% to 12% sodium carbonate by weight, 2% to 6% sodium dodecyl benzene sulphonate by weight, 25.5% to 29.5% sodium hydrosulphite by weight and 0.8% to 1.7% octyl-phenol-polyoxyethylene ether by weight.

6. The method for making the degreasing agent as claimed in claim 5, wherein the degreasing agent includes 38% of trisodium phosphate by weight, 20% of sodium silicate by weight, 10% of sodium carbonate by weight, 2% of sodium dodecyl benzene sulphonate by weight, 29% of sodium hydrosulphite by weight and 1% of octyl-phenol-polyoxyethylene ether by weight.

7. The method for making the degreasing agent as claimed in claim 4, wherein the tank is an ultrasonic tank.

8. The method for making the degreasing agent as claimed in claim 7, wherein the ultrasonic tank is applied to an electrical current of the direct current power about 2A and 3A.

* * * * *